US006839994B2

(12) United States Patent
Proctor

(10) Patent No.: US 6,839,994 B2
(45) Date of Patent: Jan. 11, 2005

(54) IDENTIFIER AND METHOD OF MARKING ARCHERY CABLES

(76) Inventor: Robert G. Proctor, Rt. 2 Box 64, Lenore, ID (US) 83541

( * ) Notice: Subject to any disclaimer, the term of this patent is extended or adjusted under 35 U.S.C. 154(b) by 0 days.

(21) Appl. No.: 10/302,134

(22) Filed: Nov. 22, 2002

(65) Prior Publication Data

US 2004/0098889 A1 May 27, 2004

(51) Int. Cl.[7] ..... G09F 3/00
(52) U.S. Cl. ..... 40/316; 124/90
(58) Field of Search ..... 40/316; 124/90, 124/91, 92

(56) References Cited

U.S. PATENT DOCUMENTS 2,514,437 A * 7/1950 Bailhe ..... 40/316
2,914,166 A * 11/1959 Bihler ..... 40/316
4,336,087 A * 6/1982 Martuch et al. ..... 40/316
4,425,390 A * 1/1984 Changani et al. ..... 40/316
4,465,717 A * 8/1984 Crofts et al. ..... 40/316
4,579,759 A * 4/1986 Breuers ..... 40/316
4,636,271 A * 1/1987 Gandolfo ..... 40/316
4,895,129 A * 1/1990 Hedgpeth ..... 124/90
5,947,060 A * 9/1999 Weinacker ..... 40/316

* cited by examiner

*Primary Examiner*—Gary C. Hoge
(74) *Attorney, Agent, or Firm*—Brian C. Trask

(57) ABSTRACT

An apparatus and method for marking stretches of archery rigging cables to facilitate selection of a desired cable stretch from among other stored cables. The invention may be embodied as a device constructed for addition to a stretch of any archery cable. The device provide an add-on surface carrying indicia, typically pre-printed, corresponding to the cable stretch to be marked. In a preferred first embodiment, the add-on surface is provided by a length of heat-shrink tube. In a second desirable embodiment, the tube, or a portion of a tube, may be formed from a length of adhesive tape wrapped circumferentially about the cable. A third desirable embodiment includes holding structure inserted between separated strands of a portion of a cable stretch.

5 Claims, 1 Drawing Sheet

IDENTIFIER AND METHOD OF MARKING ARCHERY CABLES

BACKGROUND

1. Field of the Invention

The present invention relates generally to archery products, and particularly to a device and a method for marking archery cables to facilitate accuracy of cable selection and for inventory control.

2. State of the Art

Archery cables are commonly stocked, by both retail stores and manufacturers of archery products, in a broad range of sizes and conformations (e.g. various lengths, single stretch or multi-stretch drawstrings and end cable combinations, variable spacing between end loops and nocking point or intermediate reinforcing wraps) to fit a variety of bow types and models. The materials of construction of an archery cable typically include strands of metal or string and typically form an irregular surface composed of small diameter strands. Such surfaces generally are not conducive directly to hold printed indicia due to the generally rough texture of the surface, and potential for relative motion between strands forming the surface.

Retail outlets may be required to stock over 100 different cables to service current and prior-sold archery tackle. Such required variety in stocked cable stretches inevitably leads to a jumble of similar cable stretches being stored in a single container, or certain cable stretches being misplaced during restocking. Cable stretches for disparate archery bows can look confusingly similar, but be operationally incompatible. In such case, cable stretches must be individually measured to determine their length and conformation, and to verify that an appropriate cable stretch has been selected.

Sometimes, cable stretches are packaged, for retail sale, inside of a resealable clear envelope. In such case, the package itself may be labeled, typically either by writing on its surface with an indelible marker, or affixing an adhesive label to the exterior of the envelope. However, cables may sometimes be removed from their envelopes (e.g. to test fit to a bow), and returned to an incorrect envelope. As a consequence, the retailer may subsequently either lose a sale, or sell an incorrect cable, because that cable is misidentified. Furthermore, the cable identification parameters carried by the package are unavoidably disassociated from the cable when the cable is removed from that package and installed onto an archery bow. Consequently, when such a cable requires replacement, a time consuming inquiry may be required to determine the required parameters of a replacement cable.

In certain cases, a flat label may be attached to a cable stretch to provide cable identification. Typically, such flat labels are paper rectangles that can be tied to the cable at the end of a leash formed by a length of string or twist-tie. Such a tied label flops about at the end of its leash, and can become entangled with other stored cables and labels. Furthermore, such a label would be at least an annoyance, if not a hazard, if the label were to be left attached to a cable installed on an archery bow. A consumer will inevitably remove such a label from the cable when the cable is installed on an archery bow. Consequently, the cable identification characteristics are disassociated from the cable, making replacement of the cable at a future time more difficult.

In the past, Capro Cable, a cable manufacturer located in Willis Tex., used a hot stamping/printing process to mark an identification for a particular manufacturer onto a plastic coating of steel buss cable stretches. The hot stamping process impressed an ink or die into the plastic coating of the pig tail section of certain steel buss cable stretches. The plastic coating substrate was an inherent component of the cable material used to form the buss cable stretches. The manufacturer's identity was applied to the cable stretches for the purpose of reducing liability concerns over use of substandard cable stretches. As presently understood, no use was made of such marking to provide other cable characteristics, such as cable length, or applicable archery bow model on which the cable stretch may be used.

The present arrangement for providing archery cable identification can be undesirably time consuming, and is fraught with opportunity for error and inconvenience. A better way to label archery cables is desired to increase speed and accuracy of cable selection. A device providing tidy and durable display of cable characteristics, and that can remain attached to a cable stretch would be an improvement.

BRIEF SUMMARY OF THE INVENTION

The present invention provides an apparatus and method for marking stretches of archery rigging cables to facilitate selection of a desired cable stretch from among other similar stored cables. Rigging cable stretches on which the invention may be employed include cable stretches adapted to form separate drawstring portions, combined drawstring and end-stretch cable portions, or separate end-stretches of various archery rigging cables. The invention may be employed to advantage on any cable, or cable portion, of any cable used in the rigging for any type of archery bow, including long bows, recurve bows, and compound bows. Cables receiving the invention may be formed from wire, string, or any other material suitable for use in rigging between ends of opposite flexible limbs of any archery bow.

The invention may be embodied as a device for addition to a stretch of archery cable. The device provides an add-on surface operable to carry identifying indicia relating to the cable. The add-on surface provides an improved label carrying surface that is different, typically providing a larger smooth area, than a surface inherent in material forming the cable itself. In general, the device may be left on the cable even subsequent to rigging the cable stretch on an archery bow. The add-on surface typically is pre-printed with indicia corresponding to important characteristics of the cable stretch to be marked. The indicia may indicate: a length of the cable stretch, a manufacturer of the cable stretch, a manufacturer of an archery bow on which the cable stretch may be entrained, a model of an archery bow on which the cable stretch may be used, and/or other information pertaining to a particular rigging portion replaced by the cable stretch.

In a preferred first embodiment, the add-on surface is formed as an exterior surface of a length of tube having an open interior portion adapted for reception along a length of the cable. In such an embodiment, the tube generally may be affixed to the cable at a desired axial location along the cable. Certain of such tubes may include a material operable to reduce in diameter upon application of heat to the tube.

In a second desirable embodiment, the tube, or a portion of a tube, may be formed from a length of adhesive tape. In such case, the length of tape is typically wrapped circumferentially about the cable at a desired location. A third desirable embodiment may be configured and arranged as a wedge for insertion between separated strands of a portion of a cable stretch.

The invention may be used for marking a stretch of archery rigging cable to facilitate identification, for retrieval of a desired cable from among other cables, and to provide visual verification feedback that a selected cable is a desired cable. A procedure for such use includes the steps of: first, providing a stretch of archery rigging cable. Second, providing a device including a surface that carries identification indicia related to the cable, with the device being adapted for attachment to the cable. Then finally, attaching the device to the cable at a desired axial position along the cable.

When the device is embodied as a section of tube including an external surface that carries the indicia, the procedure for its use includes: threading the cable axially through the tube; sliding the section of tube along the cable to a desired axial location of the cable; and affixing the tube to the cable at the desired axial location. Sometimes, heat may be used to shrink the tube, whereby to affix the tube onto the cable. When the device includes a length of adhesive tape, the procedure for its use typically includes wrapping the length of tape circumferentially about the cable to affix the tape at a desired axial location of the cable. When the device has holding structure adapted for engagement between separated strands of a portion of the cable, procedure for its use includes: separating strands of the cable at a desired installation location on the cable for the device; placing the holding structure between the separated strands; and causing the separated strands to engage the holding structure.

BRIEF DESCRIPTION OF THE DRAWINGS

In the drawings, which illustrate what are currently considered to be the best modes for carrying out the invention.

DETAILED DESCRIPTION OF THE ILLUSTRATED EMBODIMENT(S)

Figure 1:
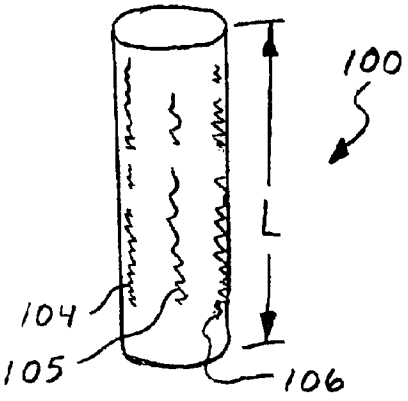
FIG. 1 is a view in perspective of a first and currently preferred embodiment of the invention.

As illustrated, in FIG. 1, the present invention may be embodied as a tube, generally indicated at 100. In the currently preferred embodiment, tube 100 is typically a short-length tube cut from a bulk-length of premanufactured tubing. Tube 100 has a length, generally indicated at L, that can be aligned with an axis of an archery cable at an installed location of tube 100 onto that cable. Preferred material for forming a tube 100 exhibits the ability to shrink in diameter upon exposure of tube 100 to heat. Application of heat to a tube 100 is one currently preferred way to affix a tube 100 to an archery cable.

Figure 2:
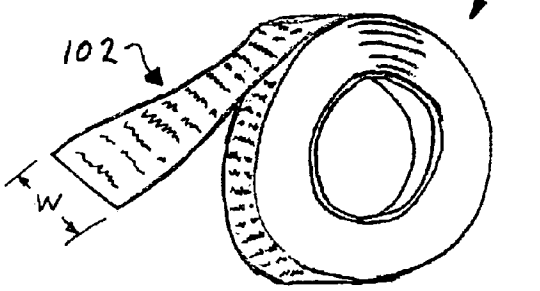
FIG. 2 is a view in perspective of a roll of adhesive tape for use in making a second embodiment of the invention.

One alternative material suitable for constructing a tube 100 includes adhesive tape, such as indicated generally at 101 in FIG. 2. Tape 101 desirably is manufactured carrying pre-printed indicia, generally indicated at 102, or such indicia can be applied subsequent to forming a tube 100. Tape 101 may be wrapped about a cable to form a tube 100 having a length aligned to an axis of an archery cable at the location of the installed tube 100. The length of the tube 100 may be formed by the width of the tape, indicated generally at W, if a short length of tape 101 is wrapped circumferentially about a cable. Alternatively, the width of the tape 101 may be wrapped circumferentially about the cable, or the tape 101 may be wrapped at an angle about a cable to form an irregular-shaped tube 100. Indicia 102 can be oriented aligned with the width W, aligned with the length of the tape 101, or at any other angle.

Tube 100 carries one or more indicia, such as indicated at 104, 105, and 106, designating information about a particular archery cable. Indicia, such as illustrated indicia 104–106, may individually be identical, distinct or unique, partially repetitive, or any combination of the foregoing. In general, indicia 104–106 convey information to inform a viewer about characteristics of the cable on which the invention is installed. Information conveyed by indicia typically include one or more of the cable: length, type, manufacturer, and applicable model of bow on which the cable may be installed. Such information desirably is repeated at one or more intervals around a circumference of the tube 100 to enable a viewer to see the desired cable information independent of an orientation of the tube 100 on a cable, or orientation of a cable in its for-sale packaging.

Figure 3:
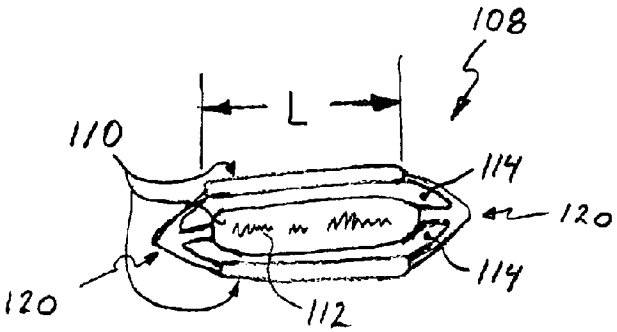
FIG. 3 is a view in perspective of a third embodiment of the invention.

An alternative cable labelling device, fashioned generally as a wedge and generally indicated at 108, is illustrated in FIG. 3. Wedge 108 carries one or more surfaces 110 on which to display cable labelling indicia 112. Desirably, a plurality of surfaces 110 are disposed circumferentially spaced apart around an axis of the wedge 108. Such spacing may enable a viewer to see the desired cable information independent of an orientation of the wedge 108 on a cable, or orientation of a cable in its for-sale packaging. Typically, a plurality of troughs or slots 114 are provided in which to entrain separated strands of a cable stretch for purpose of anchoring the wedge 108 inside an archery cable. When wedge 108 is installed in an archery cable, surface 110 has a length, generally indicated at L, maintained in an alignment with an axis of that archery cable at the installed location.

Figure 4:
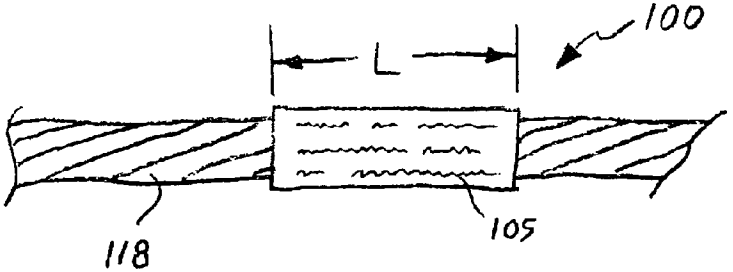
FIG. 4 illustrates either of the embodiments in FIGS. 1 or 2 in an installed position on a cable.

FIG. 4 illustrates a tube 100 installed on a portion of an archery cable 118. As is readily apparent, a length L of tube 100 is maintained in alignment with the axis of the cable 118 at the installation location. Therefore, any indicia carried on tube 100, such as indicia 105, are maintained in a preferred and readable orientation. Such a maintained orientation of indicia 105 may be contrasted with the random orientation to be expected from indicia carried by a conventional two-sided tag that is tied to a cable 118. In contrast to a label carried on a leash tied to a cable, the tube 100 is a tidy way to provide cable information in that the tube 100 inherently will avoid becoming entangled with other tubes or cables.

Figure 5:
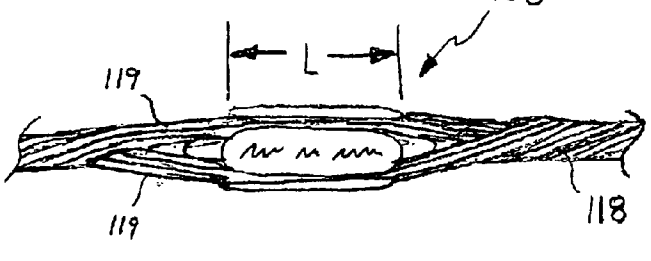
FIG. 5 illustrates the embodiment of FIG. 3 installed on an archery cable.

FIG. 5 illustrates the embodiment of FIG. 3 installed in between separated strands 119 that form a cable stretch 118. As illustrated in FIG. 3, end portions, generally indicated at 120, may provide a taper to resist string damage by fraying. Alternatively, the ends 120 may simply be flat surfaces oriented substantially orthogonal to an axis of the device that is parallel to length L. In any event, the wedge 108 may be formed as short-length sections cut from a long-length extruded cross-section shape. As with a tube 100, indicia 112 carried by wedge 108 may be hand-written onto a surface such as surface 110, silk-screened, or applied by any suitable printing operation. Additionally, wedge 108 provides a tidy label that inherently will avoid becoming entangled with other wedges or cables.

A notable benefit provided by certain preferred embodiments of the invention is that the device may remain installed in, or on, a cable stretch even when the cable is strung onto an archery bow and placed into service. When such a cable stretch requires a replacement, the required characteristics for the replacement cable are then readily obtainable from the indicia carried on the device. Therefore, a correct replacement cable stretch may be specified without requiring time-consuming research.

The invention can be used as a device for marking a stretch of archery rigging cable to facilitate identification, for retrieval of a desired cable from among other cables, and to provide visual verification feedback that a selected cable is a desired cable. Typically, installation of the device includes the steps of: 1) providing a stretch of archery rigging cable; 2) providing a device adapted for attachment to the cable; and 3) attaching the device to the cable at a desired axial position along the cable. Devices according to the invention include a surface operable to carry identification indicia related to the cable (such as cable length). Attachment of the device generally is operable to maintain a length of the device parallel to an axis of the cable.

When the device is embodied as a tube section 100, the tube 100 may be installed onto a cable stretch 118 by threading an end of the cable stretch through the tube section 100, and placing the tube 100 at a desired axial location along the cable 118. If the tube 100 is formed from a section of heat-shrink tubing, the tube 100 may then be heated to shrink a diameter of tube 100 into a friction fit engagement with cable 118. Of course, other affixing procedures may be used, including adhesively bonding a tube 100 to a cable 118, or applying adhesive tape circumferentially around one or more ends of the tube 100 and the cable 118. Also, adhesive tape 101 may be wrapped circumferentially around a cable 118 directly to form a tube 100.

When the device is embodied as a wedge, such as wedge 108, strands 119 of a cable stretch 118 are separated to permit placing structure of wedge 108 between the strands 119. Then, the strands 119 are released to permit engagement of the strands 119 in receiving structure, such as one or more of channels 114. Tensioning the cable 118 (e.g. by installing the cable 118 onto an archery bow), inevitably retains a wedge 108 at the desired installation location along a length of a cable 118.

While the invention has been described in particular with reference to certain illustrated embodiments, such is not intended to limit the scope of the invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for marking a stretch of archery rigging cable to facilitate identification, for retrieval of a desired cable stretch from among other cable stretches and to provide visual verification feedback that a selected cable stretch is a desired cable stretch, comprising the steps of:

a) providing an archery rigging cable stretch;

b) providing a device comprising a surface operable to carry identification indicia related to said cable stretch, said device being adapted for attachment to said cable stretch, said attachment being operable to maintain a length of said device parallel to an axis of said cable stretch; and c) attaching said device to said cable stretch at a desired axial position along said cable stretch.

2. The method of claim 1, wherein:

said device comprises a section of tube comprising an external surface that carries said indicia; and step c) comprises the steps of:

c1) threading a portion of said cable stretch axially through said tube;

c2) sliding said section of tube along said cable stretch to a desired axial location on said cable stretch; and c3) affixing said tube to said cable stretch at said desired axial location.

3. The method of claim 1, wherein:

said device comprises a length of adhesive tape; and step c) comprises the step of:

c1) wrapping said length of tape circumferentially about said cable stretch to affix said tape at a desired axial location on said cable stretch.

4. The method of claim 1 wherein:

said device comprises wedge structure adapted for engagement between separated strands of a portion of cable forming said cable stretch; and step c) comprises the steps of:

c1) separating strands of said cable at a desired installation location for said device on said cable stretch;

c2) placing said wedge structure between said separated strands; and c3) causing said separated strands to engage said wedge structure.

5. In combination: an archery cable stretch and a labelling device affixed to the archery cable stretch, wherein:

said labelling device carries identifying indicia, relating to said cable stretch, on a visible surface; and structure of said labelling device is configured and arranged:

to maintain a first length of said labelling device substantially in alignment with an axis of said cable stretch at an installed position of said labelling device on said cable stretch; and to dispose said surface apart from said axis by a substantially uniform distance sized in general agreement with a radius of said cable stretch, wherein:

said labelling device comprises a plurality of arms configured and arranged for insertion between separated strands of said cable stretch, each arm spacing apart a said surface from said axis.

* * * * *